US006103965A

United States Patent [19]

Kumagai

[11] Patent Number: 6,103,965

[45] Date of Patent: Aug. 15, 2000

[54] MUSICAL TONE SYNTHESIZING APPARATUS, MUSICAL TONE SYNTHESIZING METHOD AND STORAGE MEDIUM

[75] Inventor: Tomoyuki Kumagai, Hamamatsu, Japan

[73] Assignee: Yamaha Corporation, Hamamatsu, Japan

[21] Appl. No.: 09/338,854

[22] Filed: Jun. 23, 1999

[30] Foreign Application Priority Data

Jul. 16, 1998 [JP] Japan ..... 10-216555
Mar. 24, 1999 [JP] Japan ..... 11-079522

[51] Int. Cl.[7] ..... G10H 1/06; G10H 7/00

[52] U.S. Cl. ..... 84/622; 84/659

[58] Field of Search ..... 84/600–602, 622, 84/659

[56] References Cited

U.S. PATENT DOCUMENTS 5,300,727 4/1994 Osuga et al. ..... 84/622
5,712,438 1/1998 Nakata .
5,998,722 12/1999 Kondo ..... 84/622

FOREIGN PATENT DOCUMENTS 6-222760 8/1994 Japan .
10-049161 2/1998 Japan .

*Primary Examiner*—Jeffrey Donels
*Attorney, Agent, or Firm*—Morrison & Foerster

[57] ABSTRACT

A musical tone synthesizing apparatus includes a tone color selecting device that classifies a plurality of tone colors set in the main body thereof into a plurality of categories, and selects a tone color based on the categories into which the tone colors have been classified. An expanded tone color supplying device supplies a plurality of expanded tone colors to the tone color selecting device. The tone color selecting device classifies the expanded tone colors supplied from the expanded tone color supplying device into a plurality of categories, in substantially same manner as used for the tone colors set in the main body, and selects an expanded tone color based on the categories into which the expanded tone colors have been classified. Further, a musical tone synthesizing method and a storage medium storing a program executable by a computer are provided to perform the same functions as the musical tone synthesizing apparatus.

14 Claims, 9 Drawing Sheets

FIG.3

| Instrument Group | Pgm # | Bank 0 | Bank 1 | Bank 3 | Bank 6 | Bank 8 | .... | Bank 127 |
|---|---|---|---|---|---|---|---|---|
| Piano | 1 | GrandPno | GrndPnoK | | | | | |
| | 2 | BritePno | BritePnoK | | | | | |
| | 3 | E.Grand | ElGrPnoK | | | | | |
| | 4 | HnkyTonk | HnkyTnkK | | | | | |
| | 5 | E.Piano1 | El.Pno1K | | | | | |
| | 6 | E.Piano2 | El.Pno2K | | | | | |
| | 7 | Harpsi. | Harpsi.K | | | | | |
| | 8 | Clavi. | Clavi.K | | | | | |
| ⋮ | ⋮ | ⋮ | | | | | | |
| Ensemble | 49 | Strings1 | | S.Strngs | | SlowStr | | |
| | 50 | Strings2 | | S.SlwStr | | LegatoSt | | |
| | 51 | Syn.Str1 | | | | | | |
| | 52 | Syn.Str2 | | | | | | |
| | 53 | ChoirAah | | S.Choir | | | | |
| | 54 | VoiceOoh | | | | | | |
| | 55 | Syn.Voice | | | | | | |
| | 56 | Orch.Hit | | | | | | |
| ⋮ | ⋮ | ⋮ | | | | | | |
| SFX | 121 | FretNoiz | | | | | | |
| | 122 | BrthNoiz | | | | | | |
| | 123 | Seashore | | | | | | |
| | 124 | Tweet | | | | | | |
| | 125 | Telphone | | | | | | |
| | 126 | Helicptr | | | | | | |
| | 127 | Applause | | | | | | |
| | 128 | Gunshot | | | | | | |

MUSICAL TONE SYNTHESIZING APPARATUS, MUSICAL TONE SYNTHESIZING METHOD AND STORAGE MEDIUM

BACKGROUND OF THE INVENTION

1. Field of the Invention

The present invention relates to a musical tone synthesizing apparatus, a musical tone synthesizing method, and a storage medium, which enable classification or categorizing of tone colors, and selection of a tone color from one of categories into which the tone colors were classified.

2. Prior Art

Conventionally, there is known a musical tone synthesizing apparatus that classifies various kinds of tone colors set in a main body of the apparatus into categories, and select a tone color from one of the categories into which the tone colors were classified.

In the known musical tone synthesizing apparatus, however, when a group of expanded tone colors are added to the tone colors set in the main body by use of an expansion board (plug-in board), for example, the apparatus cannot categorize the expanded tone colors nor select an expanded tone color from one of the categories of expanded tone colors in a similar manner to that for the tone colors in the main body. When one tone color is to be selected from the group of expanded tone colors, therefore, the user first selects a set of expanded tone colors in a certain range in which the desired tone color may be included, and then selects one tone color in the range at a time while successively indexing the tone colors in the order of arrangement of the expanded tone colors. Thus, it is difficult for the user to determine what kinds of tone colors are present in the expanded tone colors, resulting in an undesirably complicated or cumbersome operation to select the expanded tone colors.

SUMMARY OF THE INVENTION

It is an object of the present invention to provide a musical tone synthesizing apparatus, a musical tone synthesizing method and a storage medium, which permit easy selection of a desired tone color from expanded tone colors, as well as tone colors set in the main body of the musical synthesizing apparatus.

To attain the above object, the present invention provides a musical tone synthesizing apparatus comprising a main body, a tone color selecting device that classifies a plurality of tone colors set in the main body into a plurality of categories, and selects a tone color based on the categories into which the tone colors have been classified, and an expanded tone color supplying device that supplies a plurality of expanded tone colors to the tone color selecting device, wherein the tone color selecting device classifies the expanded tone colors supplied from the expanded tone color supplying device into a plurality of categories, in substantially same manner as used for the tone colors set in the main body, and selects an expanded tone color based on the categories into which the expanded tone colors have been classified.

In a preferred form of the invention, the expanded tone color supplying device comprises a plurality of plug-in boards, and each of the plug-in boards supplies data representing a plurality of tone colors to the tone color selecting device.

Preferably, each of the plug-in boards supplies the data of tone colors in the format of a map, to the tone color selecting device.

Alternatively to the plug-in boards, the expanded tone color supplying device may comprise at least one external storage device, and the at least one external storage device supplies data representing a plurality of tone colors to the tone color selecting device.

Also alternatively, the at least one external storage device comprises a first storage device that stores a first software tone generator, and a second storage device that stores a second software tone generator in the form of a module that adds functions to the first software tone generator.

Also preferably, the expanded tone color supplying device comprises a communication interface, and supplies data representing a plurality of tone colors from an external device to the tone color selecting device through the communication interface.

Preferably, the musical tone synthesizing apparatus according to the present invention further comprises a display device that displays the tone color selected by the tone color selecting device.

To attain the above object, the present invention further provides a musical tone synthesizing method comprising a tone color selecting step of classifying a plurality of tone colors set in a main body of a musical tone synthesizing apparatus into a plurality of categories, and selecting a tone color based on the categories into which the tone colors have been classified, and an expanded tone color supplying step of supplying a plurality of expanded tone colors to the tone color selecting step, wherein the tone color selecting step classifies the expanded tone colors supplied in the expanded tone color supplying step into a plurality of categories, in substantially same manner as used for tone colors set in the main body of the apparatus, and selects an expanded tone color based on the categories into which the expanded tone colors have been classified.

To attain the above object, the present invention also provides a storage medium that stores a program executable by a computer, comprising a tone color selecting module that classifies a plurality of tone colors set in a main body of a musical tone synthesizing apparatus into a plurality of categories, and selects a tone color based on the categories into which the tone colors have been classified, and an expanded tone color supplying module that supplies a plurality of expanded tone colors to the tone color selecting module, wherein the tone color selecting module classifies the expanded tone colors supplied from the expanded tone color supplying module into a plurality of categories, in substantially same manner as used for the tone colors set in the main body of the apparatus, and selects an expanded tone color based on the categories into which the expanded tone colors have been classified To attain the above object, the present invention further provides a musical tone synthesizing method comprising the steps of classifying a plurality of tone colors set in a main body of a musical tone synthesizing apparatus into a plurality of categories, and selecting a tone color based on the categories into which the tone colors have been classified, supplying a plurality of expanded tone colors to the main body of the apparatus, and classifying the expanded tone colors supplied to the main body into a plurality of categories, in substantially same manner as used for tone colors set in the main body of the apparatus, and selecting an expanded tone color based on the categories into which the expanded tone colors have been classified.

The above and other objects, features, and advantages of the invention will become more apparent from the following detailed description taken in conjunction with the accompanying drawings.

BRIEF DESCRIPTION OF THE DRAWINGS

FIG. 3 is a view showing one example of tone color map;

DETAILED DESCRIPTION OF THE PREFERRED EMBODIMENTS

The present invention will be described in detail with reference to the accompanying drawings showing preferred embodiments thereof.

Figure 1:
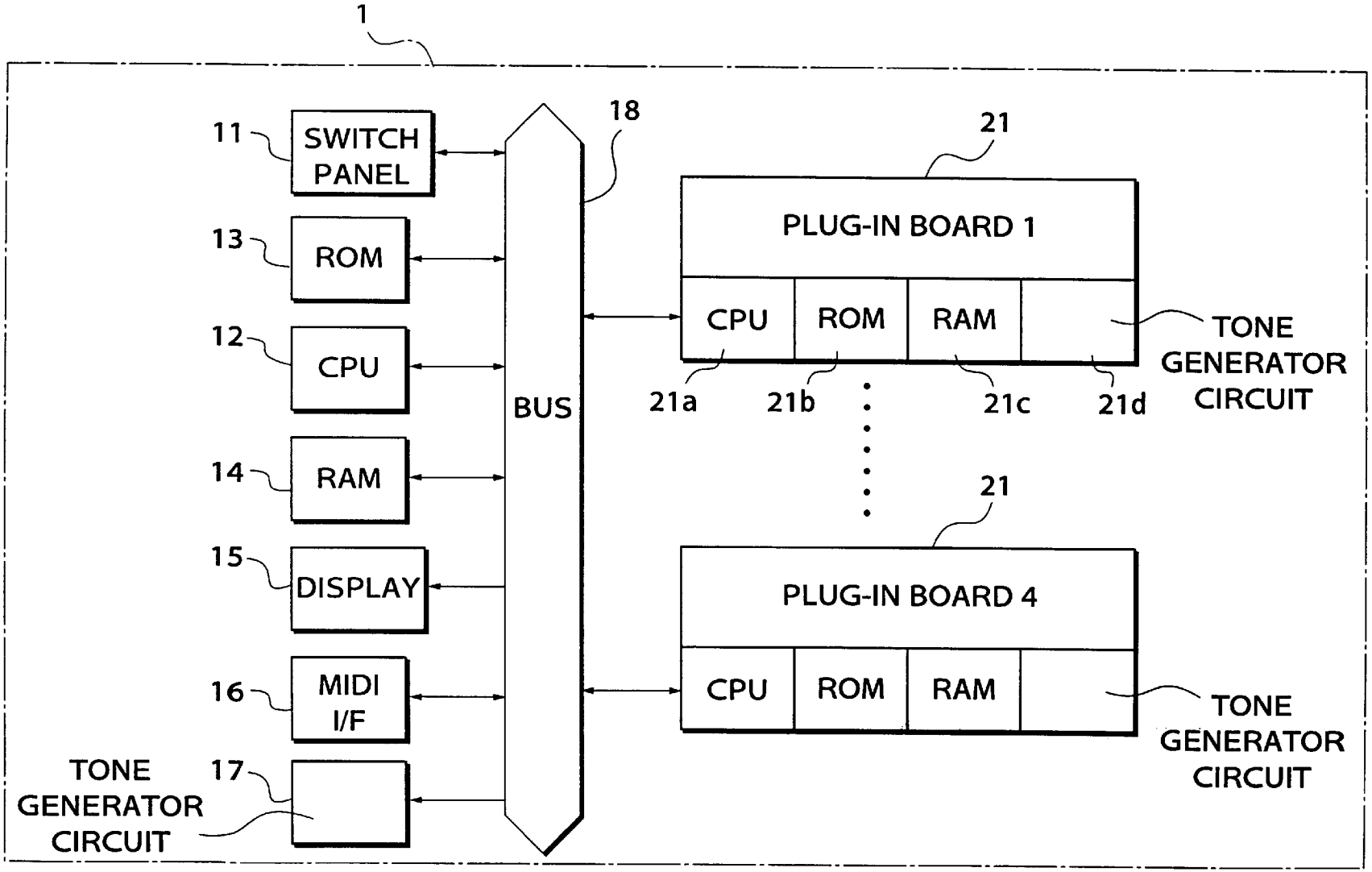
FIG. 1 is a block diagram schematically showing the construction of a musical tone synthesizing apparatus according to a first embodiment of the present invention.

Referring first to FIG. 1, there is schematically shown the construction of a musical tone synthesizing apparatus 1 according to a first embodiment of the present invention.

As shown in FIG. 1, the musical tone synthesizing apparatus 1 includes a switch panel 11 having a plurality of switches with which various kinds of information are entered, CPU 12 that governs control of the whole apparatus, ROM 13 that stores control programs to be executed by the CPU 12, table data, tone color data, and others, RAM 12 that temporarily stores performance data, various types of input information, operation results and others, and a display device 15, such as a liquid crystal display (LCD) or light emission diode (LED), for displaying various kinds of information. The musical tone synthesizing apparatus 1 further includes an MIDI interface (I/F) 16 through which MIDI (Musical Instrument Digital Interface) signals are transmitted to or received from external devices, and a tone generator circuit 17 that converts performance data entered through the MIDI I/F 16, preset performance data, and others, into musical tone signals. These components 11–17 are connected to each other via a bus 18.

The musical tone synthesizing apparatus 1 is provided with slots (not shown) into which a plurality of plug-in boards 21 are inserted. In the present embodiment, four plug-in boards 21 are provided. With the plug-in boards 21 inserted or plugged in the slots, the present apparatus 1 is able to provide expanded tone colors in addition to tone colors provided by its main body. Each of the plug-in boards 21 principally consists of a CPU 21*a*, ROM 21*b*, RAM 21*c* and a tone generator circuit 21*d*. The CPU 21*a* governs control of the whole plug-in board 21, and the ROM 21*b* stores control programs to be executed by the CPU 21*a*, table data, expanded tone colors, and others. The RAM 21*c* temporarily stores various input information, operation results and others, and the tone generator circuit 21*d* converts the performance data into a musical tone signal with a selected one of the expanded tone colors.

The control programs respectively stored in the ROMs 13 and 21*b* are prepared so that the main body 1 and each plug-in board 21 can communicate with each other through the CPUs 12, 21*a* and the bus 18. The control programs stored in the ROMs 21*b* of the respective plug-in boards 21 are prepared so that the plug-in boards 21 can communicate with each other through the bus 18.

Figure 2:
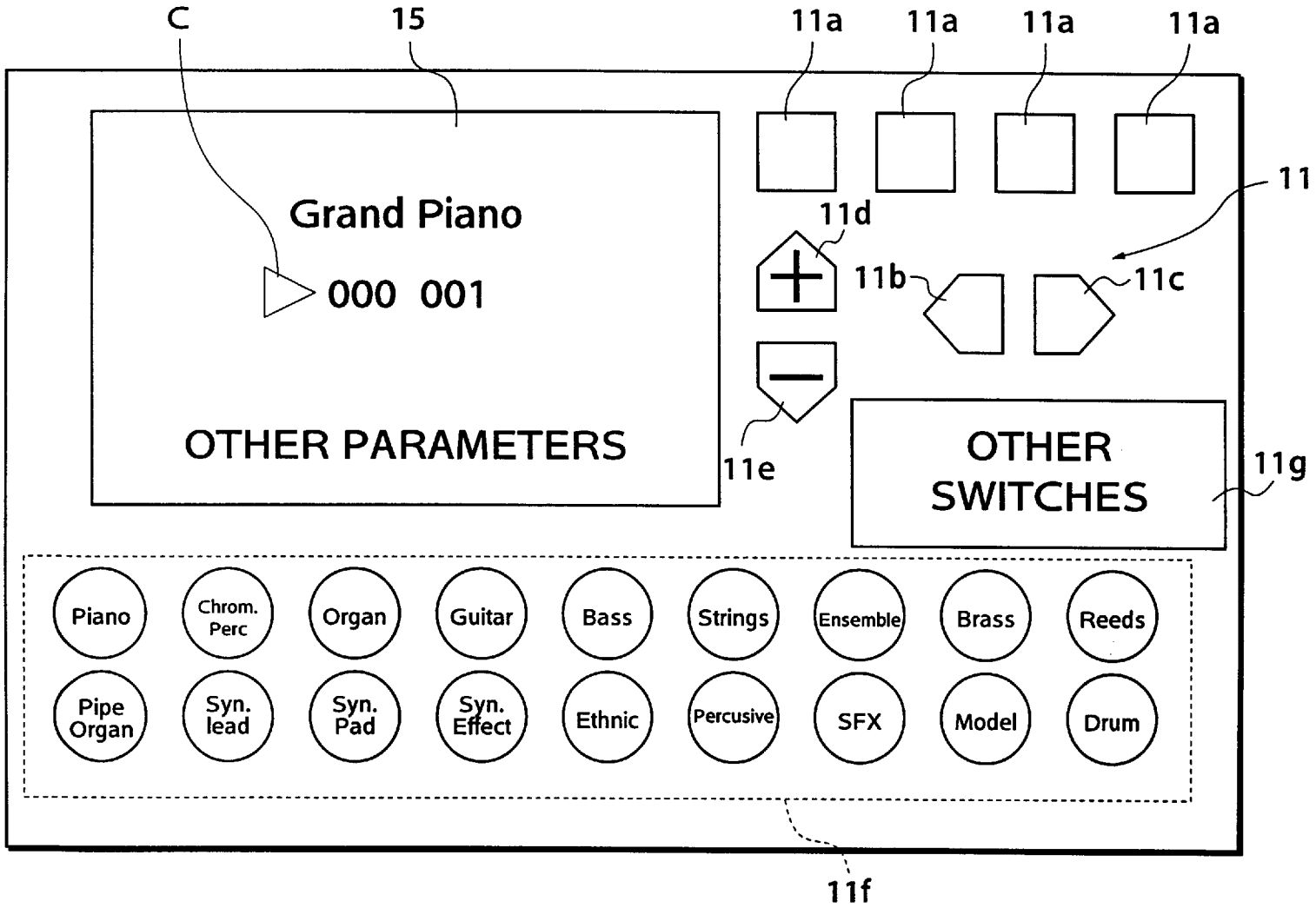
FIG. 2 is a view showing an operation panel including a switch panel and a display device of the musical tone synthesizing apparatus of FIG. 1.

FIG. 2 shows an operation panel including the switch panel 11 formed of a plurality of panel switches and the display device 15 of the musical tone synthesizing apparatus 1.

As shown in FIG. 2, the panel switches 11 include four plug-in board select switches 11*a* that are operated for selecting the respective four plug-in boards 21, a cursor key 11*b* for moving a cursor C displayed on the display device 15 to the left (or up), a cursor key 11*c* for moving the cursor C to the right (or down), and increment/decrement keys 11*d*, 11*e* for incrementing (+) or decrementing (−) the value of the parameter at which the cursor C is currently positioned. The panel switches 11 further include eighteen category keys 11*f* for selecting several categories of tone colors, and a set of other switches for setting other parameters such as a tempo or parts.

Of the category keys 11*f*, "Model" key is provided for selecting a tone color peculiar to the main body 1 or any one of the plug-in boards 21. For example, if the plug-in board 21 inserted into the main body 1 stores an expanded tone color or colors that do not belong to any one of the seventeen tone color categories ranging from "Piano" to "Drum", for example, the "Model" key is operated so as to select a desired tone color from the above expanded tone colors.

The display device 15 displays various types of information depending upon selected modes. In the example shown in FIG. 2 in which a tone color selection mode is established, tone color name ("Grand Piano"), bank select LSB ("000"), program (tone color) number ("001") and other parameters are displayed. In FIG. 2, the cursor C is located at a position where a value representing a bank select LSB (which will be described later) is displayed.

In response to a MIDI signal, a tone color is selected based on a program change message and a bank select message. Data (7-bit data) described in the program change message corresponds to the above-indicated program number. On the other hand, the bank select message is used where there are any other tone colors to be designated than those that can be designated by the program change message. Data described in the bank select message comprise bank select data MSB, LSB (each of which consists of seven bits, and which will be called "bank select MSB" and "bank select LSB", respectively). The bank select MSB determines the format of a tone color map, and the bank select LSB indicates the bank number as indicated above. The bank select LSB and the program number Pgm# are both used for determining a particular tone color.

FIG. 3 shows one example of the tone color map, which is stored in the ROM 21*b* of the plug-in board 21, and used when the bank select MSB is equal to a certain value (for example, MSB=0). In the present embodiment, the bank select MSB is associated with each plug-in board 21 (or the main body 1), and, where the plug-in boards 21 are installed in all of the slots of the main body 1, a total of five tone color maps are present, including a tone color map set in the main body. The tone color map of FIG. 3 shows one of these maps, for example, the one stored in the main body 1.

Needless to say, the bank select MSB and the plug-in board 21 are not necessarily associated with each other nor correspond to each other. Thus, a single tone color map may be created from a tone color map set in each plug-in board 21 (which may not be in the format of general tone color maps), and the tone color map set in the main body 1. In this case, the tone color maps may be integrated into one.

In the map of FIG. 3, the left-hand side column indicates program numbers Pgm#, and the top row indicates bank select LSB (Bank Nos.). In the present embodiment, each of the program number and bank select LSB consists of 7-bit data, and a maximum of 128×128 tone colors can be listed in a single tone color map. In FIG. 3, blanks indicate that no tone color is set in these locations.

In the present embodiment, each set of eight consecutive program numbers form one category, and a total of sixteen different categories are formed and arranged in such an order that the program number increases. For example, the program numbers (Pgm#) 1–8 constitute category "Piano". These categories are further subdivided into subcategories. Each of the subcategories contains one or more tone colors that are designated by one of the program numbers and correspond to respective bank select LSBs. In the category of "Piano", for example, one of subcategories that is designated by the program number "3" contains "E.Grand" and "ElGrPnK". Namely, the tone colors are roughly classified into categories each ranging over a plurality of program numbers, and more subtly classified into subcategories each corresponding to one of the program numbers and ranging over one or more bank selects LSB (Bank No.).

Figure 4:
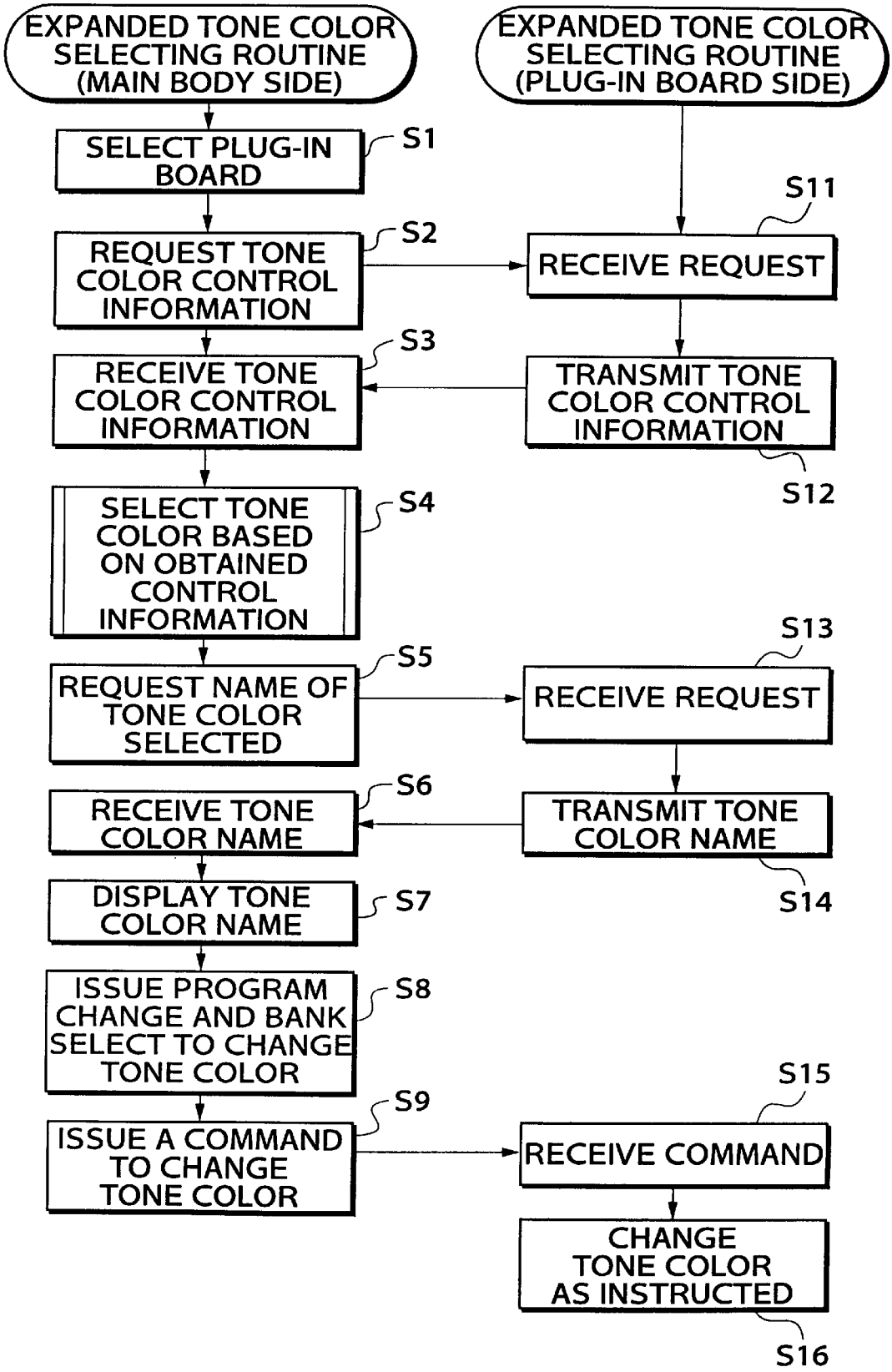
FIG. 4 is a flowchart showing a control routine for selecting an expanded tone color.
Figure 5:
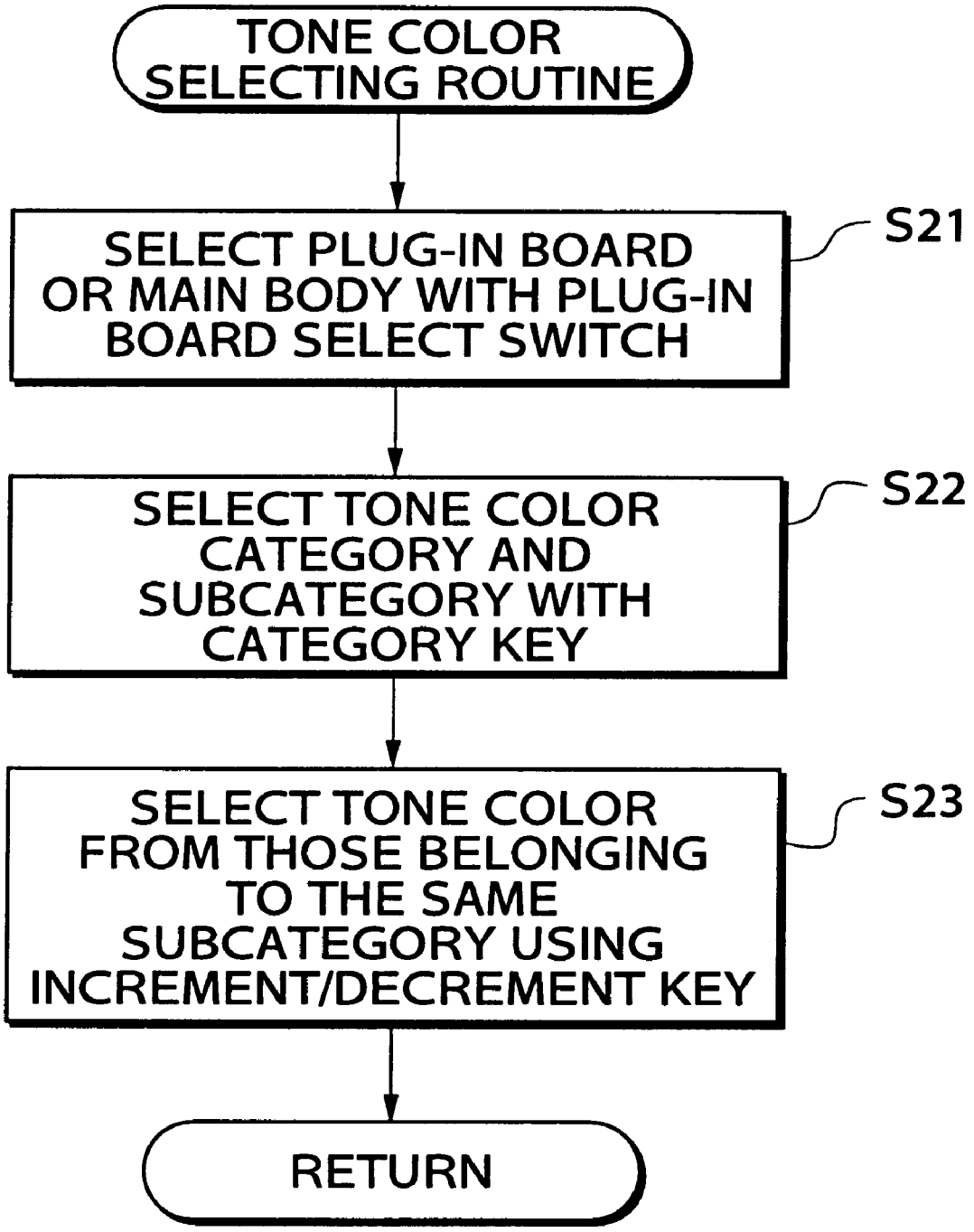
FIG. 5 is a flowchart showing in detail a subroutine for selecting a tone color using category keys, as part of the tone color selecting routine of FIG. 4.
Figure 6:
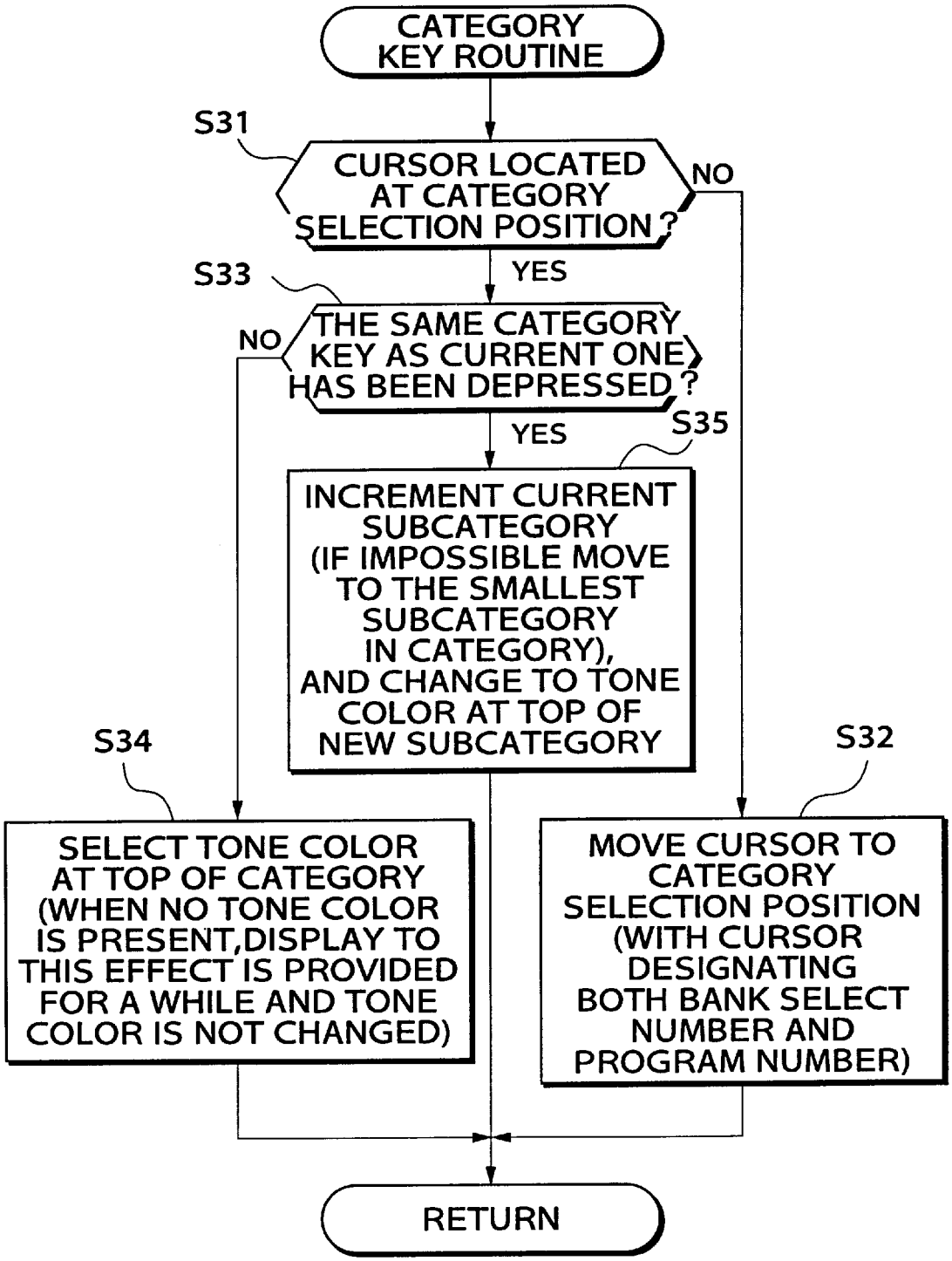
FIG. 6 is a flowchart showing in detail a routine for handling entry through category keys.

Referring to FIG. 4 through FIG. 6, there will be described control routines executed by the musical tone synthesizing apparatus 1 constructed as described above.

FIG. 4 is a flowchart showing the control flow of an expanded tone color selecting routine for selecting an expanded tone color. The present routine is composed of a routine executed by the main body (in particular, CPU 12) of the musical tone synthesizing apparatus 1, and a routine executed by the plug-in board 21 (in particular, CPU 21*a*).

If the user depresses any one of the plug-in board select switches 11*a* so as to select a desired plug-in board 21, or a desired expanded tone color, step S1 is initially executed to input the switch number of the depressed switch into a work area of the RAM 14. In the present embodiment, when one or more plug-in board(s) 21 is/are installed on the main body 1, the plug-in board select switch Ila corresponding to the slot that receives each plug-in board 21 is caused to light up, so that the user can tell which one(s) of the plug-in boards 21 may be selected. In step S1, the user depresses a desired one of the plug-in select switches 11*a* that have lightened up. In this connection, the plug-in board select switch 11*a* is designed such that its display style or form changes when it is depressed, so as to inform the user that the relevant plug-in board 21 has been selected. The change in the display form may appear as a change in color, or winking, or only the plug-in board select switch 11*a* of the selected plug-in board 21 (or the main body 1) may remain lightening up even after the lapse of a certain period of time after the switch is selected. As another example, an identification icon, or the like, may be displayed on the display device 15 so that the user can identify which one of the plug-in boards 21 (or main body 1) has been selected.

In order to obtain tone color control information owned by the plug-in board 21 corresponding to the switch number of the depressed switch, step S2 is executed in which the CPU 12 of the main body sends a request for tone color control information to the selected plug-in board 21. In the present embodiment, the tone color control information means bank select MSB and tone color map. If there is no one-to-one correspondence between the plug-in boards 21 and the tone color maps, however, the tone color control information may contain an ID of the plug-in board and a tone color map. If the tone color map is not in the format of general tone color map, but in the format of tone color data, the tone color control information may contain category recognition data that indicates which category each of the tone color data belongs to.

When the plug-in board 21 receives the request for tone color control information in step Sll, step S12 is executed in which the CPU 21*a* of the plug-in board 21 transmits its own tone color control information to the CPU 12 of the main body.

In step S3, the CPU 12 receives the tone color control information, and stores it in a tone color control information region provided at a certain location of the RAM 14. Step S4 is then executed to implement a tone color selecting routine (which will be described in detail later, referring to FIG. 5), based on the tone color control information thus obtained.

In order to obtain the tone color name of the tone color selected in step S4, the CPU 12 transmits a request for tone color name to the CPU 21*a* of the plug-in board 21 in step S5.

Upon receipt of the request for tone color name (step S13), the CPU 21*a* transmits the tone color name to the CPU 12 of the main body in step S14.

Upon receipt of the tone color name (step S6), the CPU 12 displays the tone color name on the display device 15, then generates (issues) program change data and bank select data in step S8, so as to change the current tone color to that having the received tone color name, and sends a command for a change in the tone color to the CPU 21*a* in step S9. Where the selected tone color is also selected for other part(s) than the part for which the current processing is performed, the tone color name may be displayed in step S7 along with an indication that the same tone color is selected for other part(s). In this case, it is preferable to display part number(s).

Upon receipt of the command for tone color change (step S15), the CPU 21*a* of the plug-in board 21 changes the currently set tone color to the tone color identified by the received tone name.

FIG. 5 is a flowchart showing in detail the control flow of a routine for selecting a tone color using the category keys 11*f*, as an example of the tone color selecting routine executed in step S4.

Before the routine for selecting a tone color using the category keys is described referring to the flowchart of FIG. 5, a routine for selecting a tone color using the cursor keys 11*b*, 11*c* and increment/decrement keys 11*d* will be described. This tone color selecting routine is implemented in the following manner:

When the plug-in board 21 or main body 1 is selected (the main body 1 is initially selected by default), the bank select MSB is determined based on the selected plug-in board 21 or main body 1, and the tone color map corresponding to the determined MSB is determined. In this state, the user moves the cursor C to the position of the bank select LSB (Bank i (=0, 1, 2, . . . , 127)) or the position of the program number Pgm# in the determined tone color map, using the cursor keys 11*b*, 11*c*, and selects a desired tone color by selecting the value of the parameter at the cursor position C, i.e., the bank select LSB or program number Pgm#, using the increment/decrement keys 11*d*, 11*e*.

If the increment/decrement keys 11*d*, 11*e* are operated when the cursor C is located at the position of the bank select LSB, a tone color can be selected from those in the currently selected category. More its specifically, referring to the tone color map of FIG. 3, if the increment key 11*d* is operated while the category "Piano" is selected, and the bank select LSB is "0" while the program number Pgm# is "1", the bank select LSB is incremented, and the tone color in the higher-numbered bank is successively selected. At this time, blank banks corresponding to bank select LSBs in which no tone colors are set are skipped. When the bank select LSB reaches "127", the program number Pgm# changes from "1" to "2", and the bank select LSB becomes "0", so that a tone color corresponding to the program number "2" and bank select LSB "0" is selected. In a similar manner, if the increment key 11*d* is operated when a tone color corresponding to the program number of "8" and the bank select LSB "127" is selected, it returns to the first array position in the "Piano" category, namely, the location at which the program number is "1" and the bank select LSB is "0", and its tone color is selected. If the decrement key 11*e* is operated, the bank select LSB and program number Pgm# are changed in the reverse direction with respect to the above direction, and a desired tone color is selected.

When the increment/decrement keys 11*d*, 11*e* are operated while the cursor C is located at the position of the program number, on the other hand, the subcategories corresponding to the program numbers ranging from 1 to 128 are successively selected. In this operation, each time the program number is changed, the bank select LSB is set to "0", and a tone color corresponding to the changed program number and Bank 0 is selected.

Referring next to the flowchart of FIG. 5, the routine for selecting a tone color using the category keys 11*f* will be now explained.

When the user depresses one of the plug-in board select switches 11*a* to select a desired plug-in board 21, or depresses a plug-in board release switch (not shown) to select the main body 1, the bank select MSB is determined based on the selected plug-in board 21 or main body 1, and a tone color map is determined based on the determined MSB in step S21. Although the present embodiment assumes that tone color maps are supplied in the same format from different plug-in boards 21, the respective plug-in boards 21 may provide tone color maps in different formats. In this case, the determination of the bank select MSB means determination of the types or arrangement of categories on the tone color map, and an algorithm for selecting a tone color using the increment/decrement keys 11*d*, 11*e*.

If the user then depresses one of the category keys 11*f*, the category corresponding to the depressed category key 11*f* is selected, and, if the depressed category key 11*f* is further successively depressed, one of the subcategories subordinate to the selected category is selected (step S22). A method of selecting the category and subcategory will be described in detail later, referring to FIG. 6.

Subsequently, in step S23, the user manipulates the increment/decrement keys 11*d*, 11*e*, for example, so as to select a desired tone color from various tone colors that belong to the selected subcategory.

FIG. 6 is a flowchart showing in detail the subroutine of the above step S22 for processing entry or input through the category keys 11.

In FIG. 6, step S31 is initially executed to determine whether the cursor C is located at a position that allows selection of categories, which position will be called "category selection position". If the cursor C is not at the category selection position, the cursor C is moved to the category selection position in step S32, and then the present category key routine is finished. With the cursor C located at the category selection position, the bank select LSB location and the program number location are both lightened up.

If step S31 determines that the cursor C is located at the category selection position, step S33 is executed to determine whether one of the category keys 11*f* that corresponds to the same category as the currently selected (displayed) category has been depressed or not.

If step S33 determines that another category key 11*f* corresponding to a category different from the currently selected category has bee depressed, step S34 is executed to select the tone color set at the top of the category corresponding to the depressed category key 11*f*. At this time, if there is no tone color set at the top of the category, a message or other indication that informs this fact is displayed on the display device 15 for a while, and an operation to change the tone color is suspended.

If step S33 determines that one of the category keys 11*f* that corresponds to the same category as the currently selected category has be depressed, the subcategory is incremented or decremented from the currently selected one, to be moved to a new subcategory located at the next position, so that a tone color set at the top of the new subcategory after increment or decrement is selected in step S35. If the currently selected subcategory cannot be incremented (or decremented), for example, if it is located at the last position within the relevant category (or at the first position within the category when decremented), the subcategory is moved to the one located at the first position in the category (or the one located at the last position when decremented).

In the present embodiment, as described above, the a, tone colors supplied from the plug-in board 21, as well as those set in the main body 1, are classified into a plurality of categories, and a desired tone color is selected from one of the categories into which the tone colors have been classified. Thus, a desired tone color can be easily selected from the expanded tone colors in a similar manner to the tone colors set in the main body.

Figure 7:
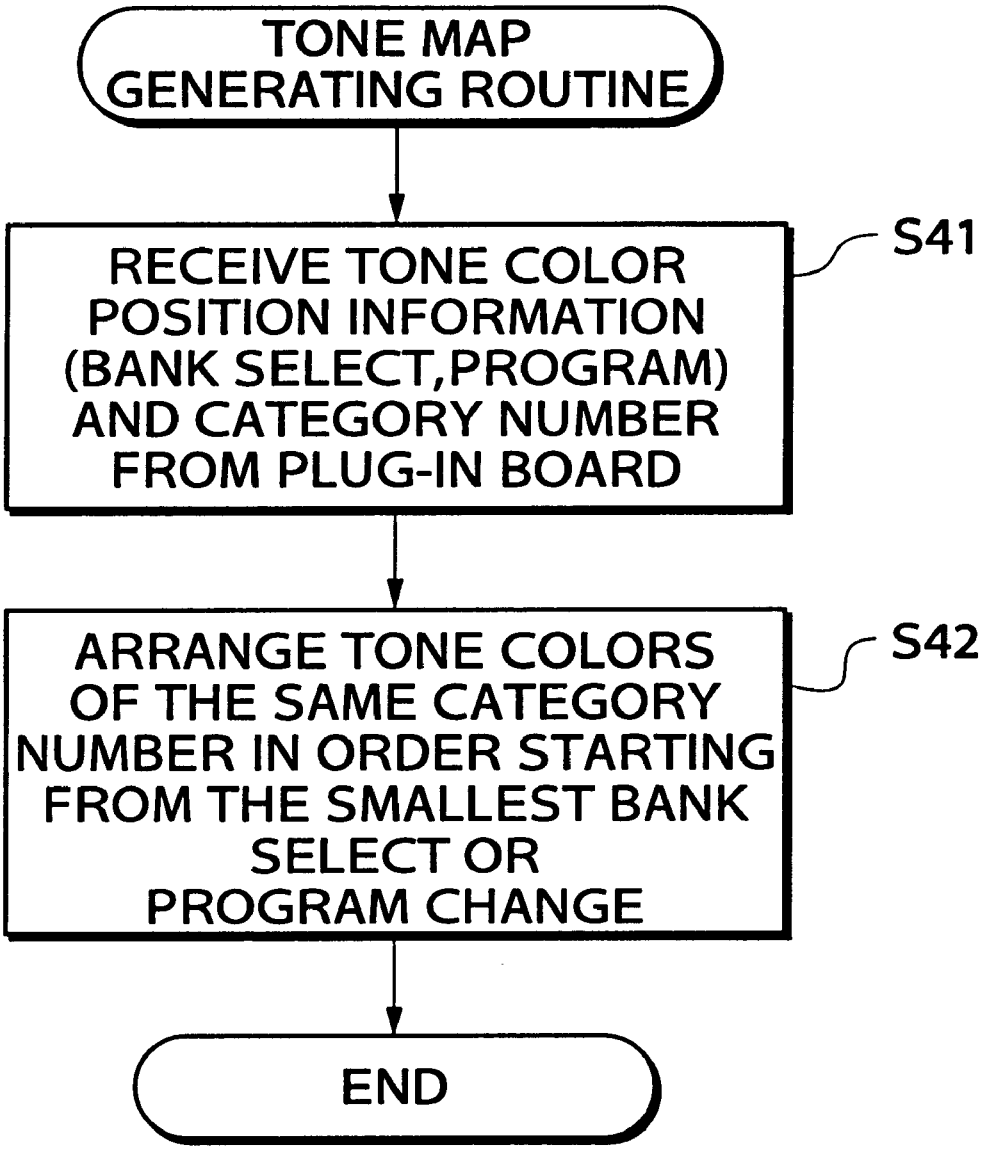
FIG. 7 is a flowchart showing a routine for newly generating a tone color map.

FIG. 7 is a flowchart showing the control flow of a tone color map generating routine for newly generating a tone color map. The present routine is implemented in such cases where the plug-in boards 21 store tone color maps in different formats, or the plug-in board 21 does not supply expanded tone colors in the format of tone color map. It is to be noted that the present routine may be executed only once when the musical tone synthesizing apparatus 1 is turned on or the plug-in board or boards is/are newly installed in the apparatus.

In FIG. 7, step S41 is initially executed in which the CPU 12 of the main body 1 communicates with the CPU 21*a* of each plug-in board 21 installed in the apparatus, so as to receive tone color position information (more specifically, bank select MSB, LSB and program change) and category number (numerical value indicating the tone color category selected by use of the category keys 11*f* shown in FIG. 2).

In step S42, tone colors of the same category number are arranged in the order starting from the low-numbered bank select LSB or program number Pgm#. Thereafter, the present tone color map generating routine is finished.

In the illustrated embodiment, only one plug-in board 21 (or main body 1) can be selected at the same time by operating the plug-in board select switch 11*a* (or plug-in board release switch) as described above with respect to step S1 of FIG. 4. The musical tone synthesizing apparatus of the present invention is not limited to this arrangement, but may be constructed such that a plurality of plug-in boards (or main body) may be selected. If the apparatus is constructed such that only one plug-in board (or main body) can be selected at the same time as in the illustrated embodiment, it is possible to easily compare a tone color provided by the main body 1 with a tone color provided by the plug-in board 21, or compare tone colors provided by different plug-in boards 21 as the plug-in board select switches 11*a* (and the plug-in board release switch) are depressed one after another. In this case, the tone color is selected only from those set in the plug-in board 21 or main body 1 that is selected at the time of selection of the tone color.

In the arrangement in which a plurality of plug-in boards 21 (and main body 1) can be selected at the same time, when one or more plug-in board select switch(es) 11*a* is/are depressed, the display mode is changed so as to indicate the depressed switch(es), thus making it possible to select a tone color from those set in all of the plug-in boards 21 (and/or main body 1) that are selected at the time of selection of the tone color.

For example, suppose the tone color map of FIG. 3 (bank select MSB=X) is set in the main body 1 while another tone color map (bank select MSB=Y) of the same format is set in one plug-in board 21, and both of the main body 1 and plug-in board 21 are selected at the same time. In this state, when a subcategory is selected by depressing one of the category keys 11*f*, and then the bank select LSB reaches "127" by operating the increment key 11*d*, the index or pointer does not move to the next program number, but the current program number is maintained. Then, the bank select LSB is set to "0", and, after the bank select MSB is changed from "X" to "Y", the bank select LSB is incremented up to "127". If the increment key 11*d* is further operated, the bank select MSB is returns to "X", and the bank select LSB is made equal to "0" with the program number incremented by only "1". Namely, the subcategory is incremented only by In the tone color map shown in FIG. 3 in the illustrated embodiment, the program numbers are arranged in the left-hand column, and the bank select LSBs are arranged in the top row. The tone color map is not limited to this arrangement, but may be designed such that the bank select LSBs are arranged in a column, and the program numbers are arranged in a row, or the bank select LSB may be eliminated, namely, only one bank may be set as a fixed value.

In the illustrated embodiment, the expanded tone colors are provided in addition to the tone colors of the main body by use of the plug-in board(s) 21, namely, a sound source board or boards constructed as part of the hardware of the apparatus. The present invention is not limited to this arrangement, but the expanded tone colors may be provided by use of a suitable software. For example, the main body of the musical tone synthesizing apparatus may be equipped with an external storage device(s), such as a hard disc device, floppy disc device, or a CD-ROM device, or a communication interface, or the like. The present invention can be equally effectively applied to the case where these external devices are used for supplying expanded tone colors into the main body in data format.

Figure 8:
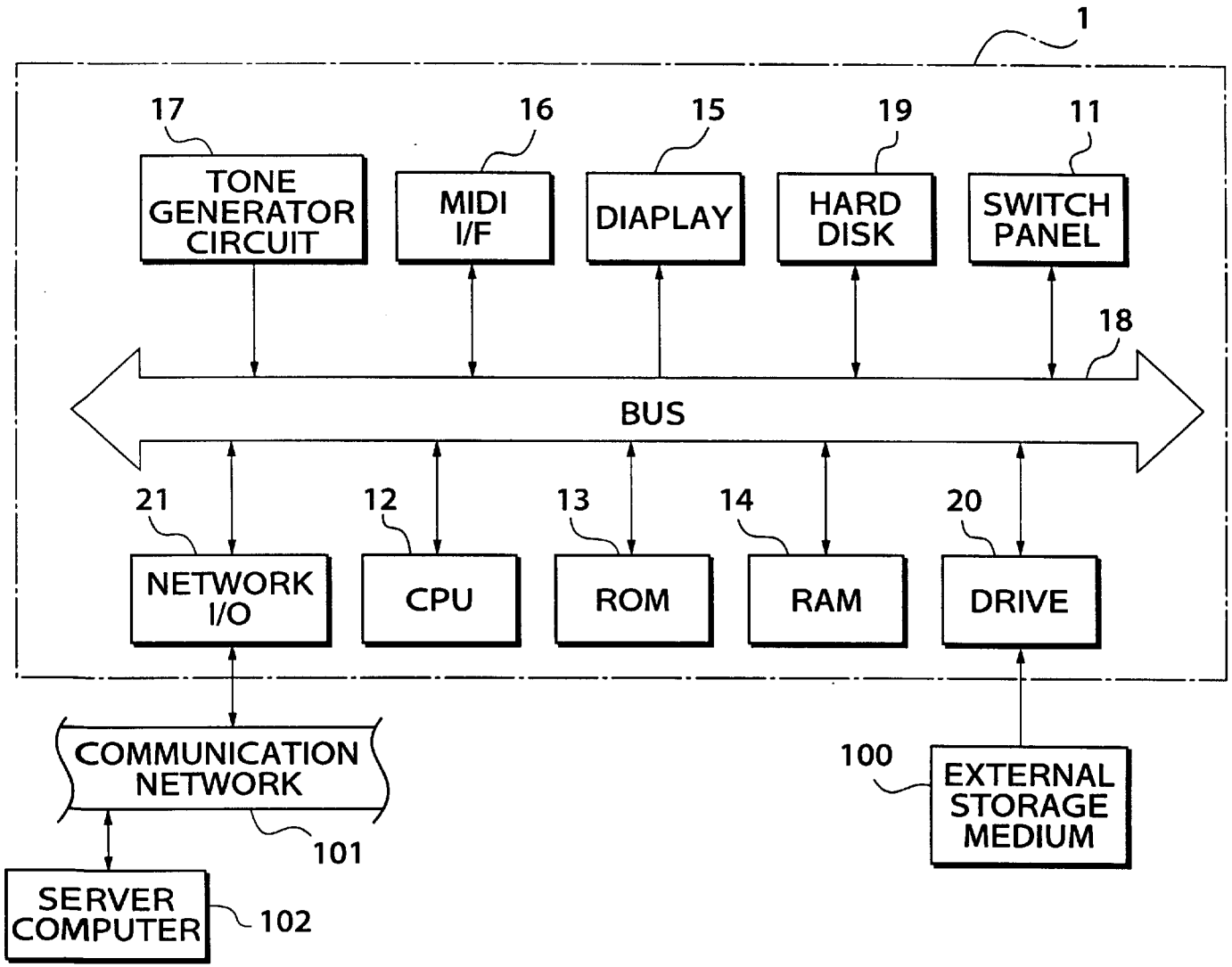
FIG. 8 is a block diagram showing the construction of a musical tone synthesizing apparatus according to a second embodiment of the present invention.

Referring to FIG. 8, a musical tone synthesizing apparatus according to a second embodiment of the present invention will be described wherein a software is used for supplying expanded tone colors to the main body. In the present embodiment, expanded tone data is supplied from a hard disc device 19 (external storage device), instead of the plug-in boards 21 of the first embodiment, to the CPU 12 of the main body. Also, the CPU 21*a*, ROM 21*b*, RAM 21*c* and the tone generator circuit 21*d* of the first embodiment are respectively incorporated into a CPU 12, ROM 13, RAM 14 and a tone generator circuit 17 provided on the side of the main body, and the latter components perform the functions of the former components. A switch panel 11, display device 15, and a MIDI I/F 16 have the same functions as the corresponding elements of FIG. 1. Expanded tone color data stored in the hard disc device 19 comprises a plurality of tone color maps. In operation, one of the tone color maps is read out from the hard disc device 19 according to the operation on the switch panel 11, and loaded into the RAM 14, so that a tone color changing operation is performed based on the categories into which the tone colors were classified, in the same manner as in the above-described first embodiment. In addition, an external storage medium 100, such as a floppy disc or a CD-ROM, may be connected to a bus 18 via a driver 20, so as to supply expanded tone color data as provided by the hard disc device 19. Furthermore, a communication network 101 may be connected to the bus 18 through a network I/F 21, so as to enable an external server computer 102 to supply expanded tone color data as provided by the hard disc device 19. The expanded tone color data supplied from the external storage medium 100 or external server computer 102 is also processed in the same manner as the expanded tone color data provided by the hard disc device 19, so that a tone color changing operation is performed based on the categories into which the tone colors were classified.

The above-described construction of the present embodiment makes it easy to select a desired tone color from the expanded tone colors, as well as those set in the main body, as in the first embodiment as described above.

While the tone generator circuit 17 composed of hardware or physical components is employed on the side of the main body of the apparatus of the first embodiment as described above, a software tone generator in the form of a program or the like may be employed as the tone generator of the main body. In this case, the expanded tone colors may be received in data format, as described above. In addition to the software tone generator of the main body, another external software tone generator may be provided for supplying expanded tone colors to the main body. The present invention may be equally effectively applied to such a musical tone synthesizing apparatus using software tone generators.

Figure 9:
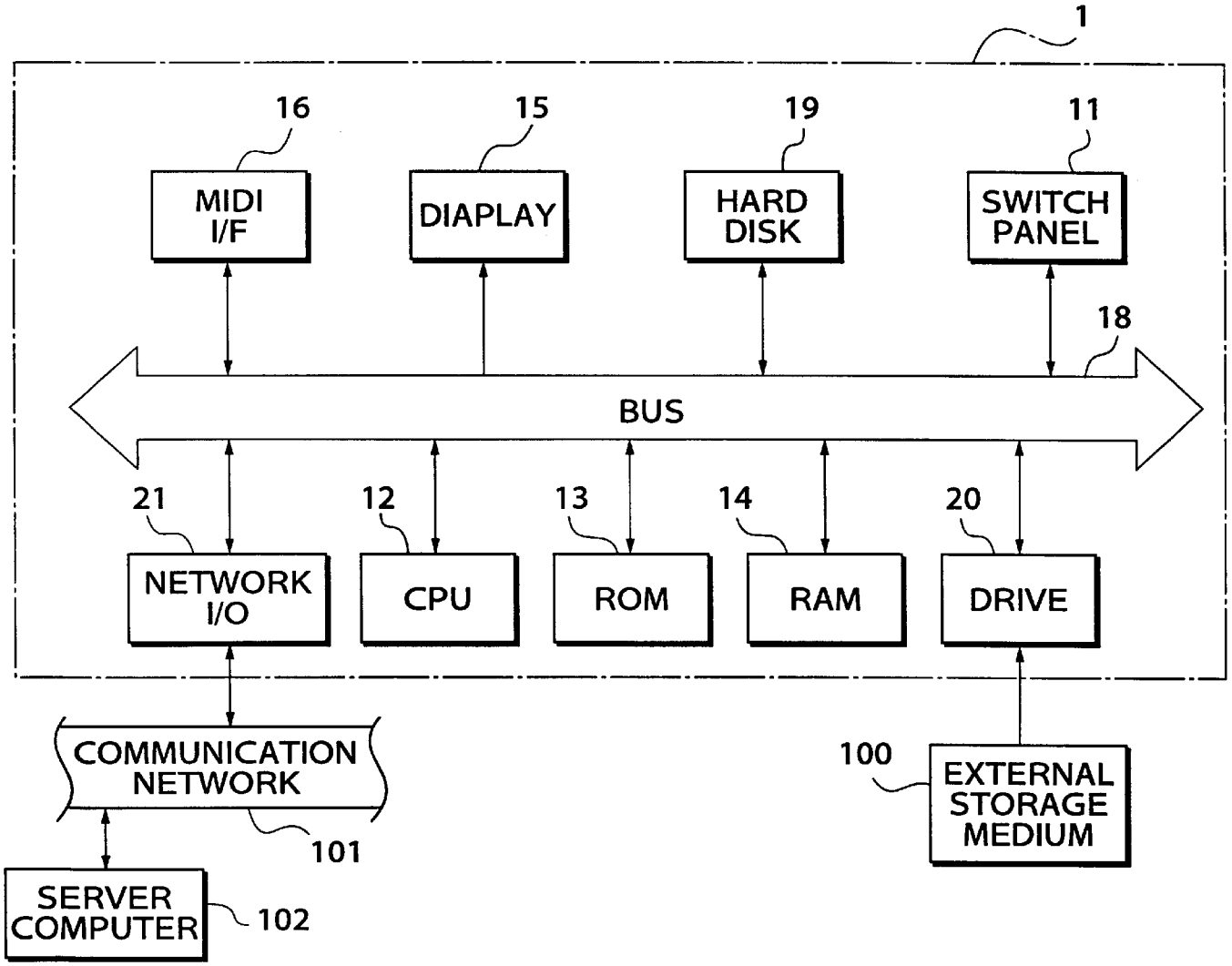
FIG. 9 is a block diagram showing the construction of a musical tone synthesizing apparatus according to a third embodiment of the present invention.

Referring to FIG. 9, a musical tone synthesizing apparatus according to a third embodiment of the present invention will be described wherein a software tone generator provided in the main body and an external software tone generator are used. In the third embodiment, the tone generator circuit 17 as a hardware unit included in the structure of FIG. 8 is replaced by a software tone generator that is stored in the hard disc device 19 of the main body. An example of the software tone generator is Wave Table tone generator, model "S-YXG100", manufactured and sold by the assignee of the present application, under registered trademark "Software Synthesizer". On the other hand, the external storage medium 100 stores, as an external software tone generator, a VA (Virtual Acoustic) tone generator that is supplied in the form of a module that adds functions to the Wave Table tone generator stored in the hard disc device 19. An example of this type of tone generator is Soft Synthesizer Plug-In, model "Poly-VL" that was recently developed by the assignee of the present application. The Wave Table tone generator stored in the hard disc device 19 reads out a waveform that was obtained by sampling in advance, and thus generates a musical tone. On the other hand, the VA (Virtual Acoustic) tone generator stored in the external storage medium 100 is able to generate a plurality of musical tones at the same time. The VA tone generator generates virtual sound of an instrument through computation, and generates musical tones by simulating the sounding structure of a natural instrument, such as vibration of the air or resonance of the main body of the instrument, so as to achieve realistic tone color changes as provided by an acoustic instrument. The use of this tone generator makes it possible to reproduce a brass ensemble composed of up to eight brass instruments, such as saxophone, trombone, and trumpet. For example, if band performance such as percussion or keyboard is reproduced by the Wave Table tone generator, and parts of strings and woodwinds are reproduced by the VA tone generator, more expressive or richer reproduction of musical tones than one obtained by the prior art can be achieved only by using a general-purpose personal computer as the musical tone synthesizing apparatus of the present invention. The Wave Table tone generator stored in the hard disc device 19 and the VA tone generator stored in the external storage medium 100 each contain tone color data in the form of a plurality of tone color maps. In operation, the CPU 12 reads out one of the tone color maps according to the operation on the switch panel 11, and loads it into the RAM 14, so as to change tone colors utilizing the categories into which the above tone colors were classified, in the same manner as in the first embodiment.

The above-described structure of the present embodiment also makes it easy to select a desired tone color from the expanded tone colors, as well as those set in the main body, as in the first embodiment as described above.

The object of the present invention may also be attained by supplying a system or an apparatus with a storage medium in which a set of software program codes that achieves the functions of the present invention are recorded, and causing a computer (CPU 12 or MPU) of the system or apparatus to read out and execute the program codes stored in the storage medium.

In this case, the set of program codes itself read out from the storage medium accomplishes the novel functions of the present invention, and the storage medium storing the program codes constitutes the present invention.

The storage medium for supplying the program codes to the system or apparatus may be in the form of a floppy disc, hard disc, optical disc, magneto-optic disc, CD-ROM, CD-R, magnetic tape, nonvolatile memory card, or ROM 13, for example. Also, the program codes may be supplied from other MIDI equipment or a server computer through a suitable telecommunication network.

The functions of the present invention may be accomplished not only by executing the program codes read by the computer, but also by causing an operating system (OS) that operates on the computer to perform a part or all of actual operations according to the instructions of the program codes.

Further, the program codes read from the storage medium may be written into a memory provided in an expanded board inserted in the computer or an expanded unit connected to the computer, and a CPU or the like provided in the expanded board or expanded unit may actually perform part of or all of the operations according to the instructions of the program codes, so as to accomplish the functions of the present invention.

What is claimed is:

1. A musical tone synthesizing apparatus comprising:

a main body;

a tone color selecting device that classifies a plurality of tone colors set in the main body into a plurality of categories, and selects a tone color based on the categories into which the tone colors have been classified; and an expanded tone color supplying device that supplies a plurality of expanded tone colors to said tone color selecting device;

wherein said tone color selecting device classifies the expanded tone colors supplied from said expanded tone color supplying device into a plurality of categories, and selects an expanded tone color based on the categories into which the expanded tone colors have been classified.

2. A musical tone synthesizing apparatus according to claim 1, wherein said expanded tone color supplying device comprises a plurality of plug-in boards, and each of the plug-in boards supplies data representing a plurality of tone colors to said tone color selecting device.

3. A musical tone synthesizing apparatus according to claim 2, wherein each of said plug-in boards supplies said data of tone colors in the format of a map, to said tone color selecting device.

4. A musical tone synthesizing apparatus according to claim 1, wherein said expanded tone color supplying device comprises at least one external storage device, and said at least one external storage device supplies data representing a plurality of tone colors to said tone color selecting device.

5. A musical tone synthesizing apparatus according to claim 4, wherein said at least one external storage device comprises a first storage device that stores a first software tone generator, and a second storage device that stores a second software tone generator in the form of a module that adds functions to the first software tone generator.

6. A musical tone synthesizing apparatus according to claim 1, wherein said expanded tone color supplying device comprises a communication interface, and supplies data representing a plurality of tone colors from an external device to said tone color selecting device through the communication interface.

7. A musical tone synthesizing apparatus according to claim 1, further comprising a display device that displays the tone color selected by said tone color selecting device.

8. A musical tone synthesizing method comprising:

a tone color selecting step of classifying a plurality of tone colors set in a main body of a musical tone synthesizing apparatus into a plurality of categories, and selecting a tone color based on the categories into which the tone colors have been classified; and an expanded tone color supplying step of supplying a plurality of expanded tone colors to said tone color selecting step;

wherein said tone color selecting step classifies the expanded tone colors supplied in said expanded tone color supplying step into a plurality of categories, and selects an expanded tone color based on the categories into which the expanded tone colors have been classified.

9. A storage medium that stores a program executable by a computer, said program including instructions for performing a method comprising the steps of:

classifying a plurality of tone colors set in a main body of a musical tone synthesizing apparatus into a plurality of categories, selecting a tone color based on the categories into which the tone colors have been classified;

supplying a plurality of expanded tone colors to the main body of the musical tone synthesizing apparatus;

classifying the expanded tone colors supplied to the main body into a plurality of categories; and selecting an expanded tone color based on the categories into which the expanded tone colors have been classified.

10. A musical tone synthesizing method comprising the steps of:

classifying a plurality of tone colors set in a main body of a musical tone synthesizing apparatus into a plurality of categories, and selecting a tone color based on the categories into which the tone colors have been classified;

supplying a plurality of expanded tone colors to the main body of the apparatus; and classifying the expanded tone colors supplied to the main body into a plurality of categories, and selecting an expanded tone color based on the categories into which the expanded tone colors have been classified.

11. A musical tone synthesizing apparatus comprising:

a plurality of tone generators each capable of generating musical tones having a plurality of tone colors;

at least one first operating element for selecting the tone generators;

at least one second operating element for selecting a plurality of categories;

at least one third operating element for selecting a plurality of subcategories; and a control device responsive to selection of one of said tone generators by said first operating element and selection of one of said categories by said second operating element for setting a predetermined tone color belonging to the selected category and the selected tone generator, said control device being further responsive to subsequent selection of one of said subcategories by said third operating element for setting a tone color other than said predetermined tone color and belonging to the selected subcategory and the selected tone generator.

12. The musical tone synthesizing apparatus according to claim 11, wherein said control device is responsive to selection of a tone generator, a category, and a subcategory by said first, second and third operating elements, for referring to a tone color map having a plurality of tone colors corresponding to respective combinations of the tone generators, the categories, and the subcategories to select one of the tone colors corresponding to a combination of the selected tone generator, category, and subcategory, and for setting the selected tone color to the selected tone generator.

13. A musical tone synthesizing method comprising the steps of:

selecting a plurality of tone generators by at least one first operating element;

selecting a plurality of categories by at least one second operating element;

selecting a plurality of subcategories by at least one third operating element; and setting a predetermined tone color belonging to the selected category and the selected tone generator in response to selection of one of said tone generators by said first operating element and selection of one of said categories by said second operating element, and setting a tone color other than said predetermined tone color and belonging to the selected subcategory and the selected tone generator in response to subsequent selection of one of said subcategories by said third operating element.

14. A storage medium that stores a program executable by a computer, said program including instructions for performing a method comprising the steps of:

selecting a plurality of tone generators by at least one first operating element;

selecting a plurality of categories by at least one second operating element;

selecting a plurality of subcategories by at least one third operating element;

setting a predetermined tone color belonging to the selected category and to the selected tone generator in response to selection of one of said tone generators by said first operating element and to selection of one of said categories by said second operating element; and setting a tone color other than said predetermined tone color belonging to the selected subcategory and to the selected tone generator in response to subsequent selection of one of said subcategories by said third operating element.

* * * * *